US005368474A

United States Patent [19]

Welden

[11] Patent Number: 5,368,474

[45] Date of Patent: Nov. 29, 1994

[54] DIRECT FIRED HOT WATER GENERATOR WITH MORE THAN ONE HEAT EXCHANGE ZONE

[76] Inventor: David P. Welden, N. Indiana Ave., Iowa Falls, Iowa 50126

[21] Appl. No.: 138,499

[22] Filed: Oct. 15, 1993

Related U.S. Application Data

[62] Division of Ser. No. 38,846, Mar. 29, 1993, Pat. No. 5,305,735.

[51] Int. Cl.[5] ..... F23D 7/06

[52] U.S. Cl. ..... 431/263; 431/278; 431/328; 431/349

[58] Field of Search ..... 431/328, 263, 349, 278

[56] References Cited

U.S. PATENT DOCUMENTS

| | | | |
|---|---|---|---|
| Re. 26,167 | 3/1967 | Schuss et al. . | |
| 880,720 | 3/1908 | Cole . | |
| 1,857,804 | 5/1932 | Carlsen | 431/349 |
| 1,988,456 | 1/1935 | Lysholm . | |
| 2,536,597 | 1/1951 | Goddard . | |
| 2,721,607 | 10/1955 | Damon et al. | 431/263 X |
| 2,763,987 | 9/1956 | Kretschmer . | |
| 3,461,667 | 8/1969 | Aguet . | |
| 3,625,186 | 12/1971 | Herbst . | |
| 3,887,325 | 6/1975 | Finger et al. . | |
| 3,994,281 | 11/1975 | Godart . | |
| 4,079,586 | 3/1978 | Kincaid, Jr. . | |
| 4,083,355 | 4/1978 | Schwank | 431/349 X |
| 4,141,343 | 2/1979 | Awano et al. . | |
| 4,275,708 | 6/1981 | Wood . | |
| 4,462,342 | 7/1984 | Welden . | |
| 4,574,775 | 3/1986 | Lutzen et al. . | |
| 4,576,617 | 3/1986 | Renevut | 431/263 X |
| 4,895,136 | 1/1990 | Poppe . | |
| 5,086,731 | 2/1992 | Lockett et al. . | |
| 5,168,861 | 12/1992 | Lutzen et al. . | |

FOREIGN PATENT DOCUMENTS

| | | |
|---|---|---|
| 54-143946 | 11/1979 | Japan . |
| 476195 | 12/1937 | United Kingdom . |
| 143537 | 5/1961 | U.S.S.R. . |

OTHER PUBLICATIONS

Copy of 3-page brochure entitle Ludell Direct Contact Water Heaters from Ludell Manufacturing Company (No Date).

*Primary Examiner*—Edward G. Favors
*Attorney, Agent, or Firm*—Henderson & Sturm

[57] ABSTRACT

A burner having a first passageway for delivering a fuel/air mixture into a burner chamber is provided with an igniter spaced from the burner chamber and second and third passageways in fluid communication with the burner chamber and the igniter.

4 Claims, 4 Drawing Sheets

DIRECT FIRED HOT WATER GENERATOR WITH MORE THAN ONE HEAT EXCHANGE ZONE

This application is a division of application Ser. No. 08/038,846, filed Mar. 29, 1993, now U.S. Pat. No. 5,305,735.

TECHNICAL FIELD

The present invention relates generally to a direct fired hot water generator, and more particularly to such a hot water generator having more than one heat exchanger zone, one zone using the heat and by-products of combustion to heat water through direct contact and another zone which uses the exhaust fumes and water vapor as an auxiliary heat source.

BACKGROUND ART

Direct fired hot water generators such as that shown in U.S. Pat. No. 4,574,775 to Lutzen et al generally have a container wherein water is introduced at the top thereof and falls downwardly through a heat exchange column, with obstacles therein to prevent a straight line path therethrough and having a burner at the bottom thereof for introducing heat and products cf combustion which flow upwardly, counter to the flow of the-water flowing downwardly, whereby the water is heated by such contact. Flue gases exit the top of the container and the heated water is pumped to where the heat i to be used. After the heat has been utilized, this water is returned to the container and to the inlet therein for re-heating and re-use.

One of the problems with prior art in direct fired hot water generators is that heat is lost in the flue gases which are exhausted to atmosphere. This creates an extremely inefficient situation.

Consequently, there is a need for a direct fired hot water generator which utilizes as much of the heat from a flame as possible.

DISCLOSURE OF THE INVENTION

The present invention relates generally to a container having a chamber with a cool water inlet disposed at the top thereof in a burner near the bottom thereof. An exhaust for flue gases is disposed at the top of the container. A first heat exchange zone is disposed in the chamber above the burner inlet for permitting the rising heat and products of combustion to contact the falling water from the water inlet. A second heat exchange zone is disposed in the chamber below the first heat exchange zone and a heat exchange pipe is disposed in the second heat exchange zone for being in a direct line with the flame of the burner. A pool of heated water is disposed at the bottom of the container and is pumped therefrom through the heat exchanger in the second zone whereby the water therein will be heated and pumped to a radiator or other place where the heat is needed. A third heat exchange zone is provided where the flue gases and water vapor exit from the first heat exchange zone.

An object of the present invention is to provide an improved direct fired hot water generator.

Another object of the present invention is to provide a direct fired hot water generator with more than one heating zone.

A still further object of the present invention is to provide a direct fired hot water generator which minimizes the possibility that steam will be formed which could produce lost heat and efficiency if such steam flows out of the exhaust with flue gases.

A still further object of the present invention is to provide a direct fired hot water generator having first zone for heating water directly through contact with the heat and products of combustion of a flame ad a second zone which heats the water through a heat exchanger pipe disposed so that the pipe is in direct line or closely associated with a flame producing the heat also utilized in the first heat exchange zone.

Another object is to capture the heat of hot flue gases and water vapor and use such heat to heat the zone that the main heater is heating, a different zone, or a different medium, such as water if the other zones are heating air.

A still further object is to provide an improved burner for a hot water heater.

A still further object is to provide a pressurized hot water heating system so that pumps do not need to be bled often and so the hot water can be more easily pumped to a higher level or story to be used.

Other objects, advantages, and novel features of the present invention will become apparent from the following detailed description of the invention when considered in conjunction with the accompanying drawings.

BEST MODE FOR CARRYING OUT THE INVENTION

Figure 1:
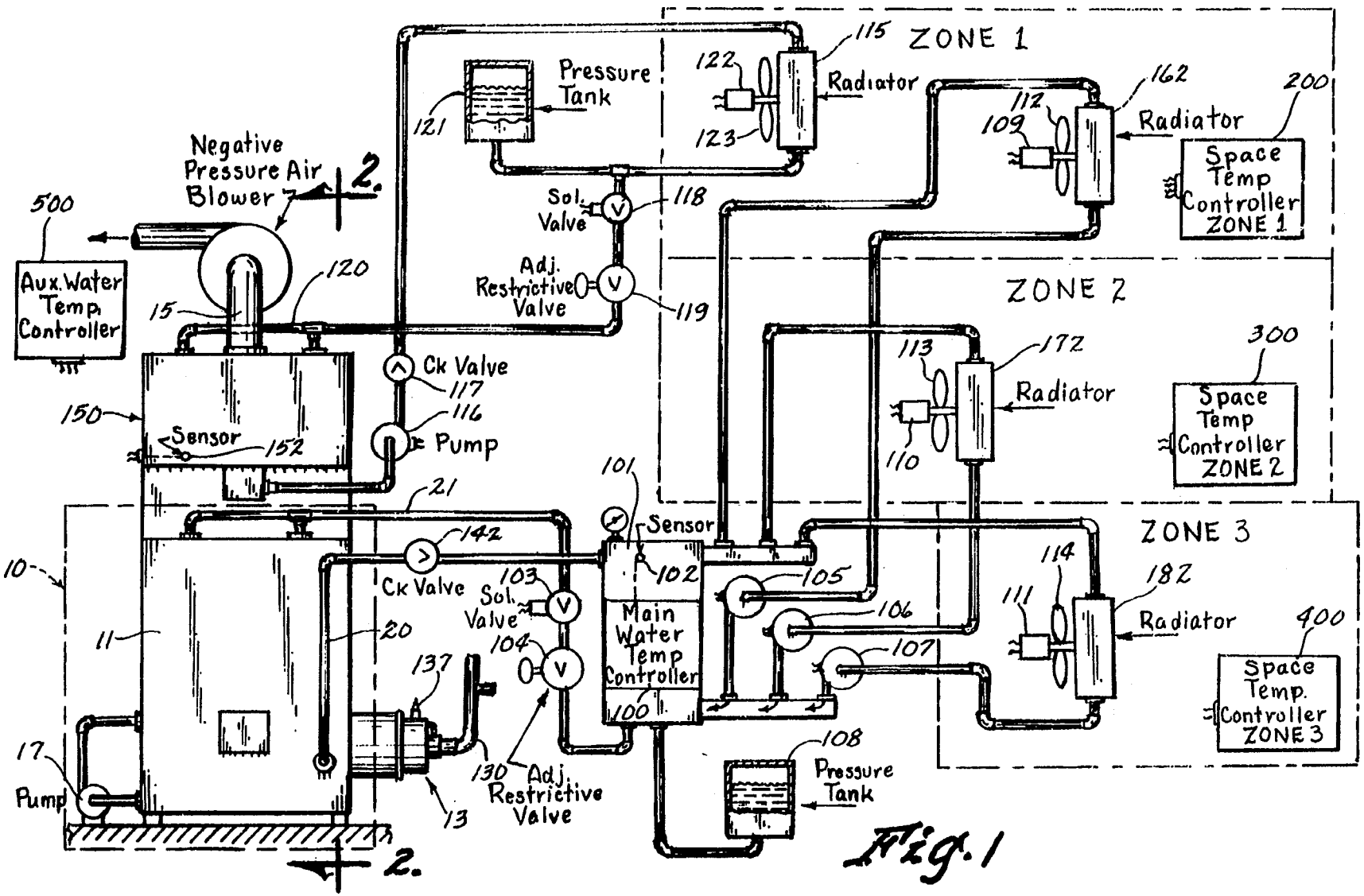
FIG. 1 is a front view of a direct fired hot water generator system shown schematically which is constructed in accordance with the present invention.
Figure 2:
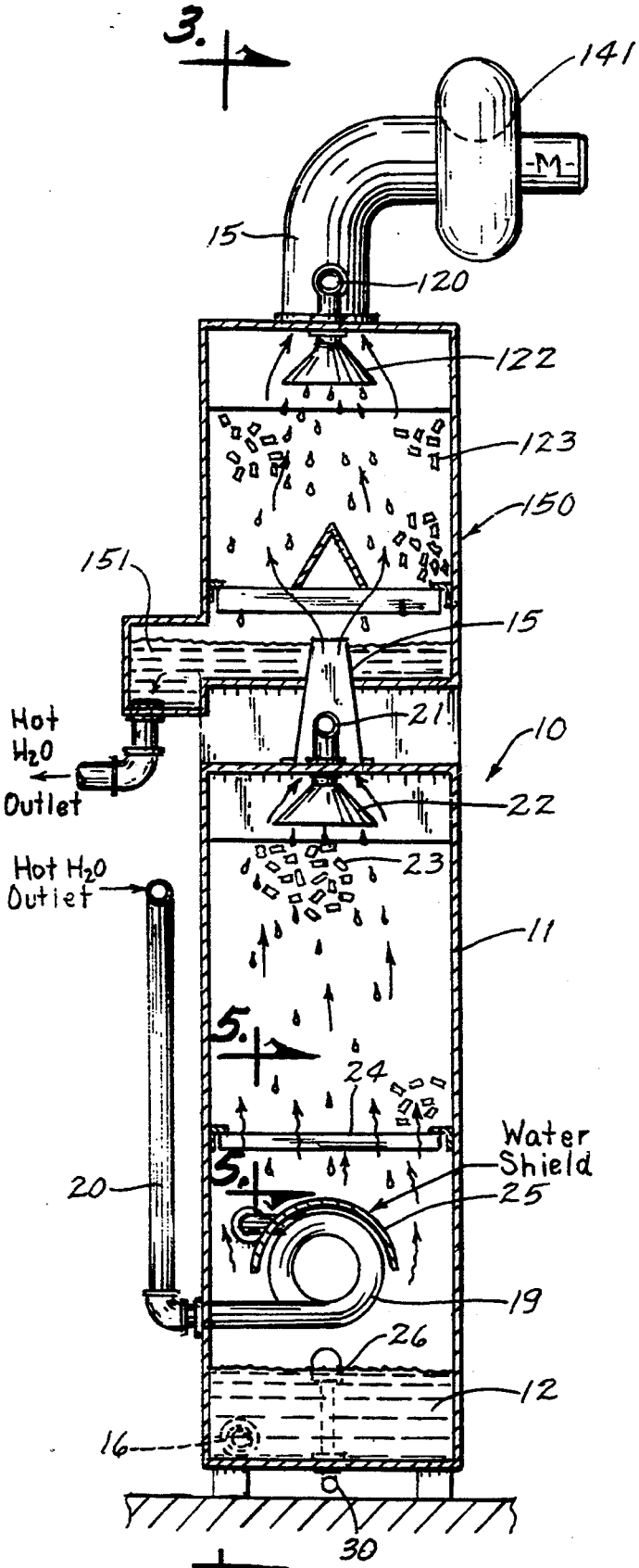
FIG. 2 is an enlarged cross sectional view taken along line 2—2 of FIG. 1.
Figure 4:
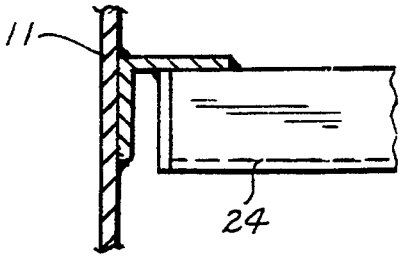
FIG. 4 is an enlarged cross sectional view taken along line 4—4 of FIG. 3.
Figure 3:
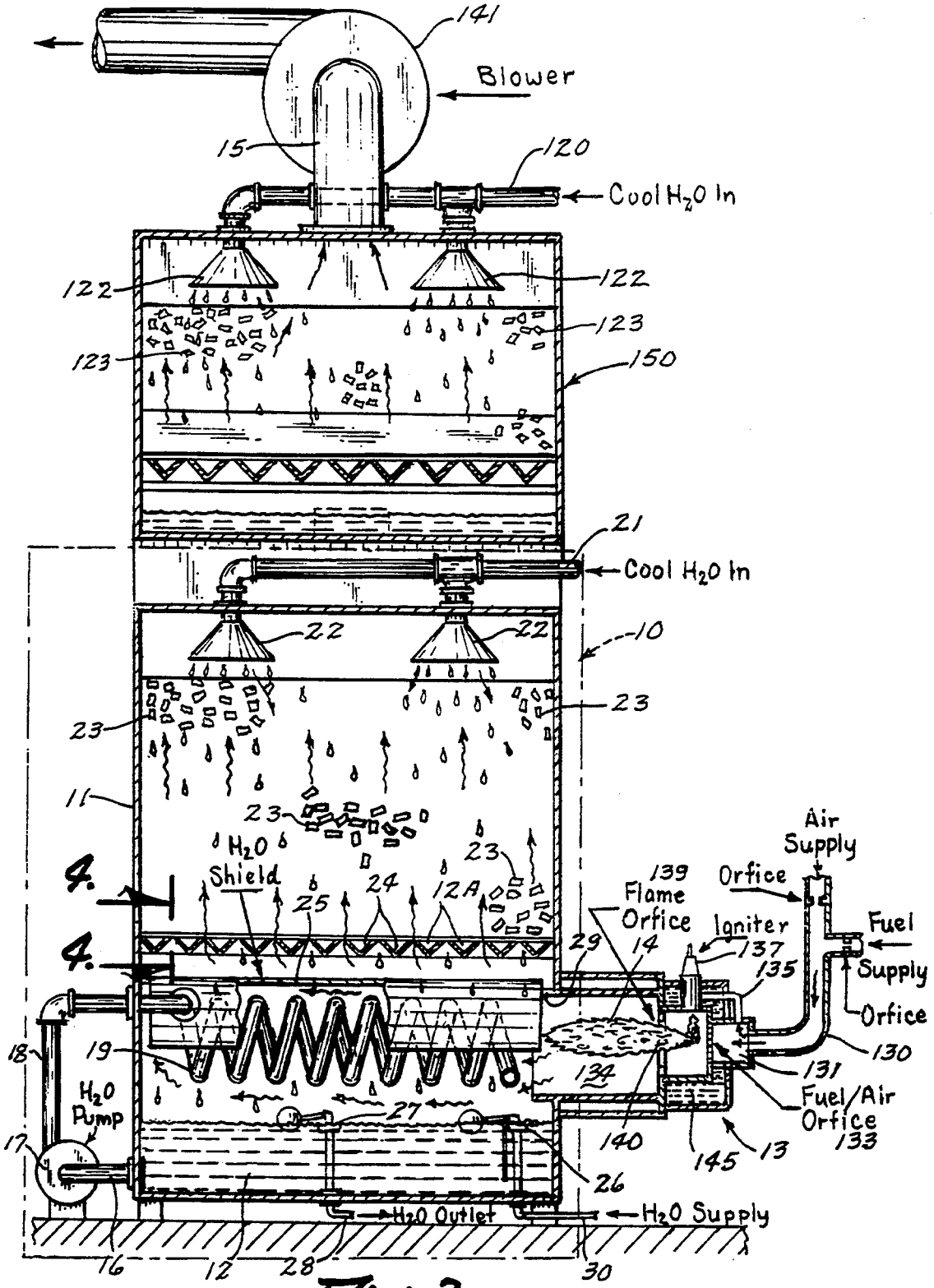
FIG. 3 is an enlarged cross sectional view taken along line 3—3 of FIG. 2.
Figure 6:
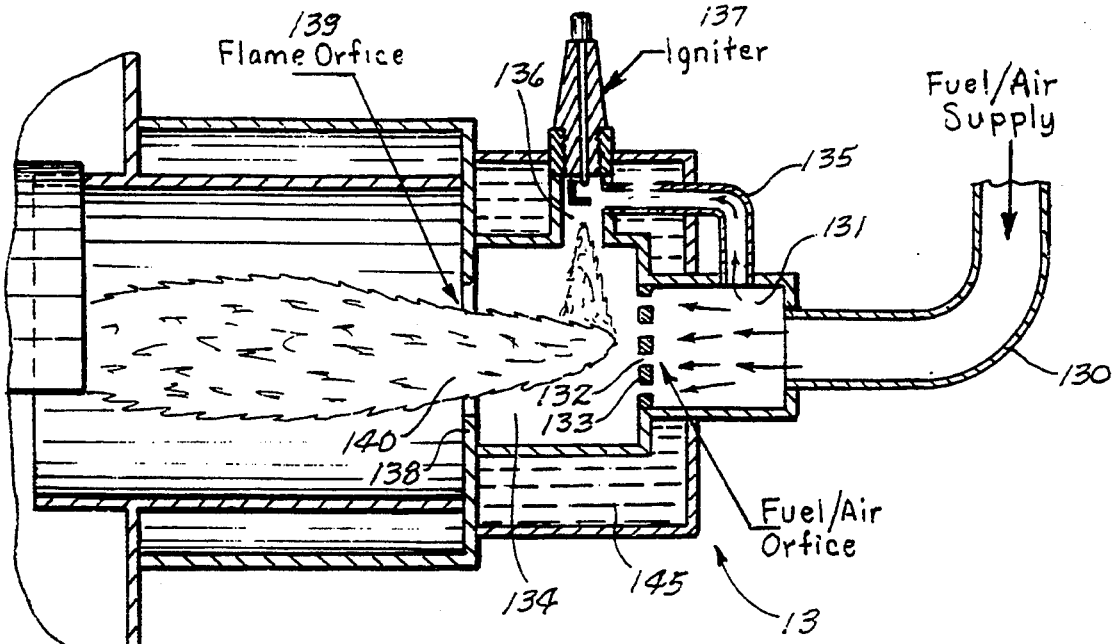
FIG. 6 is an enlarged view of the burner shown in FIG. 1.
Figure 7:
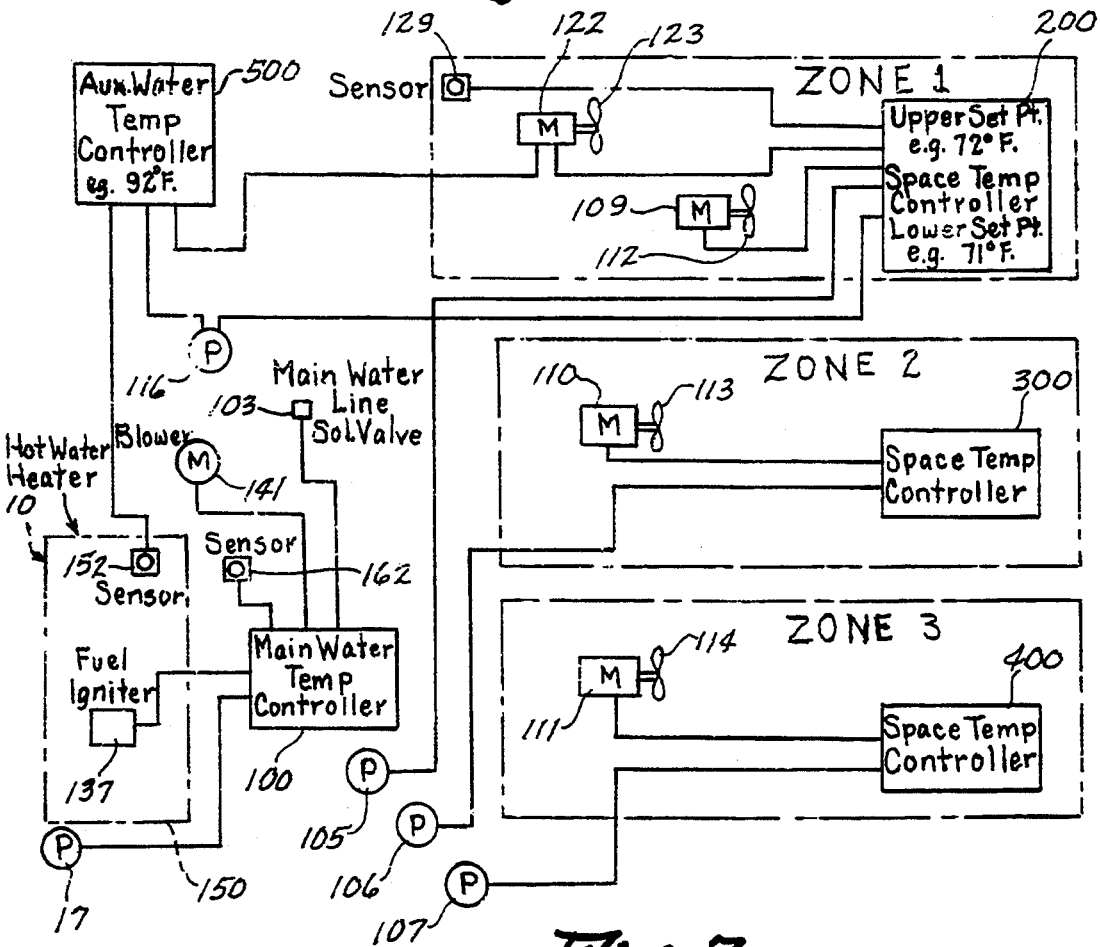
FIG. 7 is an electrical schematic view of the control system of the preferred embodiment of the present invention.

Referring now to the drawings wherein like reference numerals designate identical or corresponding parts throughout the several views, FIG. 1 shows a direct fired hot water generator (10) constructed in accordance with the present invention and shown generally in the dashed line box of FIGS. 2 and 3. A container (11) is generally sealed and includes a sealed bottom portion for holding water (12). A burner (13) is attached near the lower portion of the container (11) for producing a flame (14). An exhaust flue (15) is disposed at the top of the container (11).

A water outlet (16) is connected to a lower portion of the container (11) and a pump (17) is provided for pumping water through a pipe (16) and pipe (18) into a helical heat exchanger pipe (19). A pipe (20) is attached to the heat exchanger pipe (19) and delivers hot water to a place where the heat is to be used, for example, to a hot water radiator in a building or the like. A return pipe (21) delivers cooler inlet water to sprinklers (22) at the top of the housing (11).

Figure 5:
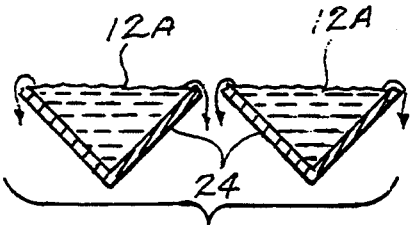
FIG. 5 is an enlarged cross sectional view taken along line 5—5 of FIG. 2.

Bricks or other ceramic objects (23) are packed into a first heat exchange zone which is defined generally as the area above angle irons (24) which serve to hold the bricks in the first heat exchange zone but allow the heat and by-products of combustion from flame (14) to go upwardly and water from the inlet nozzles (22) to pass downwardly. Referring to FIG. 5, it is noted that water (12A) collects in the angle irons and as these angle irons fill with water, the water (12A) dribbles over the side and downwardly onto a shield (25) which prevents direct contact of this falling water onto the helical heat exchanger pipe (19).

Referring to FIG. 3, at the bottom right thereof it is noted that a first float operated valve (26) is provided for supplying water to maintain the level substantially at the level shown in FIG. 3 so that in the position shown in FIG. 3, the valve (26) would be closed. As the water level lowers, the float will drop and this will cause the valve (26) to open to again restore the level of water (12) to the level shown in FIG. 3.

Conversely, another float operated valve (27) is shown connected to a water outlet (28). If the water (12) would rise above the level shown in FIG. 3, the float would move upwardly and open a valve (27) to allow water to drain out outlet (28). After the water is restored to the predetermined level shown in FIG. 3, the float would drop down to the position shown in FIG. 3 which would turn off this valve (27) and the flow-out outlet (28) would stop. The purpose of valve (27) is to prevent water from rising so high that it would rise into the flame inlet (29) and perhaps put out the flange (14). A further disadvantage of having a water level which is too high is that it is desired to have the heat exchanger pipe (19) completely above the water level of the water in the bottom of the container (11).

There needs to be a certain amount of water within the bottom of the container (11), and that is why the float operated valve (26) is present. If there is insufficient water in the bottom of the container (11), the float operated valve (26) will operated to introduce water at a higher pressure through supply pipe (30) into the lower part of the container (11). It will be appreciated that the water level always needs to cover up the opening for outlet pipe (16) in order to maintain the prime on the pump (17) and not suck air, which would cause the pump (17) to lose its prime.

In operation of direct fired hot water heater (10), the cooler water to be heated returning from a hot water radiator or the like would pass down through the sprinklers (22) and would move downwardly through the ceramic pack columns such as past bricks (23). As the water moved downwardly through the top zone, defined as that part of the container above angle irons (24), the heat and by-products of combustion will enter through opening (29) and will move upwardly between the angle irons (24) and will pass through and around all of the bricks (23), thereby causing a counter flow action of rising heat and falling water droplets which will consequently transfer the heat from the flame to the falling water droplets within the direct heat exchange zone one. Additionally, the flame (14) is aligned to be in direct alignment with helical heat exchanger pipe (19). Causing this heat exchanger pipe (19) to heat up will, of course, heat the water passing therethrough and consequently, will cause a rise of temperature of perhaps four to six degrees Fahrenheit from where the water enters outlet pipe (16) to where it exists pipe (20) shown in FIG. 2. Not only is the water heated, but the heat of the flame (14) and the by-products of combustion are reduced so that they are not so hot that they will cause steam to form as the heat and by-products of combustion continue to rise through the first zone above angle irons (24). This prevents the formation of steam which, if formed, would pass through flue (15) and likewise would result in a loss of all of the heat disposed within such steam, thereby causing an extremely inefficient situation. Downwardly passing water, of course, will pass around the heat exchanger pipe (19) because of the guard (29).

Accordingly, it will be appreciated that the direct fired hot water generator (10), has a first zone above angle iron (24) whereby the counter flow of water and the heat and by-products of combustion exchange heats water in the first zone. Then the water passing downwardly to the second heat exchange zone, generally defined by the heat exchanger pipe (19), heats water in a second zone. This arrangement also produces and minimizes the possibility that steam will be formed which substantially enhances the efficiency of such hot water generator.

Referring now to the burner (13) shown in FIGS. and 6, it is noted that there is a fuel supply inlet (130) which is a combination of fuel and air which typically has a velocity of 40 to 100 feet per minute. This fuel enters a chamber (131) and passes through openings (132) in orifice plate (133). This creates a pressure differential across the orifice plate wherein the pressure in chamber (131) is higher than the pressure in chamber (134).

A tube (135) is connected at one end thereof to chamber (131) and at the other end is in fluid communication with chamber (134) through an intermediate chamber (136) which has igniter (137) disposed therein. A water jacket (145) is disposed around the hottest portion of the burner (13) whereby circulated water can cool the burner parts.

A fire orifice plate (138) extends around and forms a flame orifice (139) which causes some of the fuel air supply mixture on each side of the flame (140) to be slowed down such that there is some unburned fuel/air on each side of the flame 140. This turbulent flow portion of the fuel/air mixture in chamber (134) on each side of flame (140) keeps the flame ignited. A gas air mixture upstream from orifice (132) does not burn because the 40 to 100 foot per minute speed thereof is above the flame propagation speed. Fire orifice plate (138) restricts the slow velocity gases and creates a back pressure which holds the flame in the fire chamber (134).

The gas air flow through tube (135) is caused by the pressure differential across the gas/air orifice (132). The gas/air mixture enters the tube (136) and is ignited by the electrical igniter (137). The flame enters the fire chamber (134), thereby igniting the slow velocity gas/air mixture along the side of the main flame (140) which, in turn, keeps the high velocity gas/air mixture or main flame (140) burning.

If the fire orifice plate (138) were not present the fuel/air mixture might exit the fire chamber (134) because the fuel/air mixture velocity exceeds the flame propagation speed, which is for example perhaps only 20 feet per second. This could consequently prevent the burner from having a flame in fire chamber (134) where the flame is needed at all times during the operation thereof.

This burner (13) can be used not only where the fuel/air supply is a positive pressure such as if a blower were to pump the fuel/air supply into the tube (130), but also applies where a blower (141) (the top of FIG. 3) is utilized to suck the fuel/air supply through the tube (130), chamber (131), orifice plate (132) and fire chamber (134). Consequently, in the embodiment shown, the pressure in chamber (134) is more negative than the pressure in chamber (131), even though both chambers are at a negative pressure. Consequently, even though these pressures are at a negative level, the fact that there is a pressure differential between the pressuring chamber (131) and the pressuring chamber (134), the fact that the negative pressure is lower in fire chamber (134) than it is in chamber (131), fuel will be drawn through the tube (135) and ignited by igniter (137).

Auxiliary heater (150) is utilized to capture and use some of the heat exiting through exhaust member (15). Typically, these flue gases could be at 180° F. and be one hundred percent saturated. These heated gases are sucked upwardly by blower (141) and are exhausted to the atmosphere. But when these flue gases pass by and through bricks (123), the bricks (123) are heated as well as the water passing out of nozzles (122). Consequently, the downwardly passing water droplets in auxiliary heater (150) will be heated by both the upwardly passing flue gases from the exhaust (15) and the heated bricks (123) thereby causing the water at (151) to be heated.

When the hot water heater (10) runs, it is set up to control the air temperature in zones 1, 2 and 3. When the furnace (10) runs, the pump (17) operates to circulate water to the top of tank (101). The temperature controller (100) has a sensor (102) in the top thereof which could for example be set at 160° F. The controller (100) shuts down the furnace (10) if the temperature at the sensor (102) in the top of tank (101) is above the set point of the controller (100) for example above 160° F. Consequently, under such a condition, the temperature causes the controller to shut down the furnace (10) by shutting off the burner (13), the pump (17) and the blower (141). It also shuts off the solenoid valve (103), which is normally open but which can be closed by the controller (100) as just explained. Check valve (142) allows flow in the direction indicated in FIG. 1 only.

The tank (101) stays pressurized even while the furnace (10) is shut down so that the circulation pumps (105), (106) and (107) can operate properly. A pressure tank (108) maintains the pressure for example through a rubber bladder and an air pocket. Consequently, as long as the temperature in zone 1, 2 or 3 is not above the set point for temperature controllers (200), (300) and (400), respectively, the motors (109), (110) and (111) will turn blowers (112), (113) and (114), respectively. If the temperature in any one of the zones 1, 2 or 3 exceeds the temperature desired, then of course heat will not be supplied therethrough through the main furnace (10) because the respective pump and motor leading from the main heater will be disengaged by the individual temperature controllers (200), (300) or (400).

It is noted that auxiliary heater (150) can operate to provide additional heat to any one of the zones, but it is shown to be added to zone 1 through a radiator (115). A pump (116) will circulate the water (151) shown in FIG. 2 upwardly through a check valve (117), through radiator (115) and then back down through a solenoid valve (118) and an adjustable restricter valve (119), which might instead be a fixed restriction, and then back down through pipe (120) to nozzles (122) shown in FIG. 2. A pressure tank 121) is optionally provided for the reasons given above with respect to pressure tank (108). A motor (122) drives a fan (123) under certain conditions which will be explained below.

As long as furnace (10) is running to provide heat to zone 1, then pump (116) and motor (122) will be running. When the temperature of the water (151) rises above the set point of temperature controller (500), for example 92° F., the controller (200) will cause the pump (116) and motor (122) to run in order to heat zone 1. Also, when the temperature in zone 1 is below the upper set point of controller (500), for example 72° F., then the pump (116) and motor (122) will run. The pulp (116) and (122) will run under the conditions just mentioned, except when the temperature zone 1 is at or above the desired temperature set on the upper set point of temperature controller (200), 72° F. in the example given, in which case the temperature controller (200) will turn off the pump (116) and motor (122). This is true even if the furnace (10) is running or the temperature at sensor (102) for controller (100) is above the set point in controller (500).

For example, assuming the set points given above, if the temperature is 68° F. in zone 1, the pump (105) will start because the temperature in zone A is below the lower set point 71° F. The pump (116) and motor (122) will start because the temperature in zone 1 is below the upper set point 72° F. When the temperature in zone 1 rises to 71.5° F., this means that the temperature has risen above the lower set point and controller (200) shuts down the pump (105) and motor (109) for fan (112) and radiator (162). Because the temperature in zone 1 has not exceeded the upper set point, the pump (116) and fan (122) will continue to operate.

Zones 2 and 3, in this example, may or may not be running. If they are, then heat is transferred to the auxiliary furnace (150). In this case, zone 1 will be heated with heat from the main furnace (10) which is not being used in zone 2 or 3. Even if the furnace (10) shuts down, for example because it has developed 160° F. water in auxiliary heater (150), then pump (116) and motor (122) would continue to run until either (a) the temperature of the water drops below 90° F. in furnace (115) or (b) the temperature in zone 1 rises above the upper set point e.g. 72° F.

Whenever the water temperature in (101) is below the set point of controller (100), e.g. 160° F., then the furnace (10) will start up.

A typical control of the auxiliary heat exchanger (150) would be that the temperature in zone 1 is preferably controlled by a temperature controller (200) such as an Omega Model CN 9111, which has two set points and a high resolution mode capable of one-tenth of a degree of resolution. The auxiliary pump (116) and the auxiliary fan (122) in zone 1 is controlled by the higher set point, for example with a one degree spread between the higher set point and the lower set point. The zone 1 pump (105) and fan (109) from a radiator (162) is connected to the main hot water generator (10) and is controlled by the lower set point of controller (200).

In typical operation, the hot water generator (10) is controlled by the temperature of the water in the tank (101) as sensed by sensor (102). An auxiliary pump (116) is run continuously whenever the hot water generator (10) is running. The fan (123) is run by motor (122) whenever the hot water generator (10) is running, except when the high set point of the controller (200) shuts it down. The auxiliary pump (116) and auxiliary fan and motor (122) and (123) are also controlled by temperature controller (500) that senses the water temperature and the auxiliary heat exchanger (150).

Obviously, many modifications and variations of the present invention are possible in light of the above teachings. It is therefore to be understood that, within the scope of the appended claims, the invention may be practiced otherwise than as specifically described.

I claim:

1. A burner for a heat generator comprising:

a burner chamber having an upstream end and a downstream end;

a first passageway for delivering a fuel/air mixture under pressure to said upstream end of said burner chamber;

an inlet orifice plate disposed between said burner chamber and said passageway for restricting the flow of the fuel/air mixture to said burner chamber and thereby creating a pressure drop across said orifice plate;

an igniter for igniting the fuel/air mixture flowing through said burner chamber at a predetermined place spaced from said burner chamber;

a second passageway in fluid communication with the burner chamber and the predetermined place of said igniter; and a third passageway in fluid communication with said first passageway upstream from said orifice plate and with said second passageway adjacent said predetermined place of said igniter whereby some of the air/fuel mixture will always be passing past the igniter during the ignition process.

2. The burner of claim 1 including an exhaust orifice plate means disposed on the downstream end of said burner chamber for preventing all of the ignited fuel air mixture from exiting the burner chamber at the same time, thereby keeping a flame in the burner chamber when the inlet velocity of the fuel/air mixture exceeds the flame propagation speed.

3. The burner of claim 2 wherein said exhaust orifice plate means includes means for causing turbulent flow in the burner chamber, thereby causing some unburned portions of the fuel/air mixture to always be present in the burner chamber.

4. The burner of claim 1 including means for causing the pressure on both sides of said inlet orifice plate to be negative, with the pressure downstream of the inlet orifice plate in the burner chamber to be more negative than the negative pressure upstream of the inlet orifice plate in said first passageway.

* * * * *

UNITED STATES PATENT AND TRADEMARK OFFICE

CERTIFICATE OF CORRECTION

PATENT NO. : 5,368,474

DATED : November 29, 1994

INVENTOR(S) : David P. Welden

It is certified that error appears in the above-indentified patent and that said Letters Patent is hereby corrected as shown below:

On the title page item [54] and column 2:

Change the title to --BURNER APPARATUS--.

Signed and Sealed this

Twenty-fourth Day of January, 1995

*Attest:*

Bruce Lehman

BRUCE LEHMAN

*Attesting Officer*

*Commissioner of Patents and Trademarks*